US008749338B2

(12) United States Patent
Takahashi

(10) Patent No.: US 8,749,338 B2
(45) Date of Patent: Jun. 10, 2014

(54) LAMINATED ELECTRONIC COMPONENT AND MANUFACTURING METHOD THEREOF

(71) Applicant: Taiyo Yuden Co., Ltd., Tokyo (JP)

(72) Inventor: Osamu Takahashi, Gunma (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 13/712,396

(22) Filed: Dec. 12, 2012

(65) Prior Publication Data

US 2013/0176096 A1 Jul. 11, 2013

(30) Foreign Application Priority Data

Dec. 15, 2011 (JP) ..... 2011-275127
Nov. 27, 2012 (JP) ..... 2012-259221

(51) Int. Cl.
*H01F 5/00* (2006.01)
*H01F 27/02* (2006.01)
*H01F 27/24* (2006.01)

(52) U.S. Cl.
USPC ..... 336/200; 336/83; 336/234

(58) Field of Classification Search
USPC ..... 336/200, 223, 232–234, 83
See application file for complete search history.

(56) References Cited

U.S. PATENT DOCUMENTS 4,689,594 A * 8/1987 Kawabata et al. ..... 336/200
5,392,019 A * 2/1995 Ohkubo ..... 336/200
5,598,136 A * 1/1997 Kano et al. ..... 336/200
6,107,907 A * 8/2000 Leigh et al. ..... 336/200
2008/0246579 A1 * 10/2008 Mizuno et al. ..... 336/205

FOREIGN PATENT DOCUMENTS

JP 2007-123726 A 5/2007
JP 4100459 B 6/2008

* cited by examiner

*Primary Examiner* — Alexander Talpalatski
*Assistant Examiner* — Mangtin Lian
(74) *Attorney, Agent, or Firm* — Law Office of Katsuhiro Arai

(57) ABSTRACT

A laminated electronic component with adjacent wires (such as coil conductors) in insulator layers inter-connected through via holes, wherein its laminate is structured in such a way that a coil-embedded layer constituted by first insulator layers and second insulator layers laminated alternately is sandwiched between a top magnetic layer and bottom magnetic layer, with external electrodes formed on both end faces. First coil conductors are formed on the first insulator layers and second coil conductors are formed on the second insulator layers, with these coil conductors connected through via holes. Formed at the end of each second coil conductor is a connection conductor of a size sufficiently large to block off the top of the via hole provided in the insulator sheet. By discharging the air in the via hole by means of pressure-bonding the laminate, the connection conductor will have a part filling inside the via hole and another part projecting on top of the via hole, with the center of the via hole recessed, to prevent shorting and cracking.

4 Claims, 7 Drawing Sheets

(B)
62
64
60
O (A)
36D
36A
32A
36B
36C
38

LAMINATED ELECTRONIC COMPONENT AND MANUFACTURING METHOD THEREOF

BACKGROUND

1. Field of the Invention

The present invention relates to a laminated electronic component and manufacturing method thereof, and more specifically to improvement of component reliability.

2. Description of the Related Art

Laminated electronic components, each formed by laminating multiple insulator layers with a pattern constituting a part of a coil conductor formed on the surface, and then connecting the patterns through via holes, thereby forming a spiral coil conductor, are utilized in various applications. Such laminated electronic components are facing the demand for component size reduction as the devices in which they are utilized become smaller, more power-efficient and higher-performance, and, in particular, laminated electronic components used as inductors in power circuits are asked to offer lower resistivity. The easiest way to reduce the resistance of a laminated electronic component is to increase the thickness of its internal conductor, and this method is adopted in many cases. At the same time, technologies to meet high reliability requirements are being examined and several methods have been proposed.

For example, the laminated electronic component described in Patent Literature 1 specified below employs the method of providing a larger land/via connection area so that stable connection can be achieved between the via and land of the laminated inductor even if the lamination accuracy in the vertical direction is poor. FIG. 7(C) shows a laminated electronic component 100 having a coil formed in a laminate 102 constituted by multiple insulator layers 104A to 104K, while FIG. 7(B) shows a plan view of the laminate 102 in FIG. 7(C) as viewed from above the insulator layer 104C. A coil pattern 106 constituting a part of the coil is formed at each specified position of the insulator layers 104C to 104I, and a land 106A is formed at one end of this coil pattern 106 and connected to the internal conduct inside a via 108.

With the aforementioned laminated electronic component 100, trying to provide a large connection area between the land 106A and via 108 as mentioned above results in a screen design where the land 106A opening is larger than the line opening (FIG. 7(A-1)). This increases the screen transmission amount and makes the print film thickness on the land 106A greater than the print film thickness on the line (FIG. 7(A-2)). Particularly in the case of a power inductor, where the line film thickness is increased for the purpose of lowering the RDC (direct-current resistance), thick film at the land and via leads to negative impact of the thickness of the internal conductor in the via. To be specific, the proportion of the internal conductor at the connection part increases when the layers are laminated and pressure-bonded, as shown in FIG. 7(C), which accounts for a number of problems such as stress cracks and shorting defects due to the connection of internal conductors at the top and bottom.

One known method to address the aforementioned problems is decreasing the screen opening ratio corresponding to the land and controlling the paste discharge volume to reduce the printed film thickness on the land 106B, as described in the laminated coil component and manufacturing method thereof in Patent Literature 2 specified below (refer to FIGS. 7(D-1) and 7(D-2)).

BACKGROUND ART LITERATURES

[Patent Literature 1] Japanese Patent Laid-open No. 2007-123726

[Patent Literature 2] Japanese Patent No. 4100459

SUMMARY

However, the technology described in Patent Literature 2 specified above requires changing the screen manufacturing method to partially change the screen opening ratio, and has problems such as making the screen more expensive and adding to the cost of the product. In an example presented in the same literature, the land (pad) thickness is adjusted to 0.31 to 0.81 times the thickness of the internal conductor (coil conductor) which is 8 μm. However, in the case of a power inductor, where the thickness of the internal conductor is approx. 40 μm, unfailingly preventing cracking and shorting by the method described in Patent Literature 2 above has been difficult.

The present invention focuses on the points mentioned above and one object of the present invention is to provide a laminated electronic component having a structure whereby adjacent wires (such as coil conductors) formed in the insulator layers are inter-connected through via holes, where such component is highly reliable in that it does not generate cracking or shorting. Another object of the present invention is to provide a manufacturing method of such laminated electronic component.

Any discussion of problems and solutions involved in the related art has been included in this disclosure solely for the purposes of providing a context for the present invention, and should not be taken as an admission that any or all of the discussion were known at the time the invention was made.

A laminated electronic component according to the present invention is a laminated electronic component having a structure whereby multiple insulator layers, each with wires comprising conductors formed on the surface, are laminated and wires on the respective insulator layers are connected, wherein adjacent wires sandwiching the insulator layers are connected by connection conductors that are formed by conductors projecting into and on top of via holes that penetrate through the insulator layers, and the connection conductors are shaped in such a way that their center is recessed to become lower than the outer periphery of the via hole.

Another laminated electronic component according to the present invention has: a coil-embedded layer where a spiral coil conductor is embedded over multiple insulator layers; a top magnetic layer laminated on the top side of the coil-embedded layer and formed by multiple magnetic layers; and a bottom magnetic layer laminated on the bottom side of the coil-embedded layer and formed by multiple magnetic layers; wherein the coil conductor integrally comprises: multiple first coil conductors that are each formed over at least one-half a turn on one insulator layer and provided on each of multiple insulator layers to constitute a part of the coil conductor; multiple second coil conductors alternating with the first coil conductors, which are each formed over at least one-half a turn on one insulator layer and provided on each of multiple insulator layers to constitute a part of the coil conductor; a first connection conductor formed on one end of the first coil conductor in a manner filling inside and projecting on top of a via hole provided in an insulator layer having the first coil conductor formed on it, wherein such first connection conductor is shaped in such a way that its center is recessed to become lower than the outer periphery of the via hole, and connects to a part of the second coil conductor below it through the part filling the via hole; and a second connection conductor formed on one end of the second coil conductor in a manner filling inside and projecting on top of a via hole provided in an insulator layer having the second coil conductor formed on it, wherein such second connection conductor is shaped in such a way that its center is recessed to become lower than the outer periphery of the via hole, and connects to a part of the first coil conductor below it through the part filling the via hole.

A manufacturing method of a laminated electronic component according to the present invention is a method of manufacturing a laminated electronic component having a structure whereby multiple insulator layers, each with wires comprising conductors formed on the surface, are laminated and wires on the respective insulator layers are connected, wherein such manufacturing method includes: a step to form a via hole at a specified position on each insulator layer; a step to form on the insulator layer the wires, as well as a connection conductor which is also an end of each wire and larger than the outer periphery shape of the via hole so as to block off the top face of the via hole to seal the air inside; a step to laminate multiple insulator layers, each with the wires and connection conductors formed on it, to form a laminate; and a step to pressure-bond the laminate.

Another manufacturing method of a laminated electronic component according to the present invention is a method of manufacturing a laminated electronic component having a spiral coil conductor embedded over multiple insulator layers, wherein such manufacturing method includes: a step to form, on a first insulator sheet having a via hole formed at a specified position, a first coil conductor formed over at least one-half a turn and constituting a part of the coil conductor, as well as a first connection conductor which is also an end of the first coil conductor formed at a position blocking off the top face of the via hole and larger than the outer periphery shape of the via hole so as to seal the air inside the via hole, to form a first insulator layer; a step to form, on a second insulator sheet having a via hole formed at a specified position, a second coil conductor formed over at least one-half a turn and constituting a part of the coil conductor, as well as a second connection conductor which is also an end of the second coil conductor formed at a position blocking off the top face of the via hole and larger than the outer periphery shape of the via hole so as to seal the air inside the via hole, to form a second insulator layer; a step to laminate multiple sets of the first insulator layer and second insulator layer alternately to the specified number of layers, to form the coil-embedded layer; a step to laminate multiple magnetic sheets to form a bottom magnetic layer; a step to laminate multiple magnetic sheets to form a top magnetic layer; a step to stack the bottom magnetic layer and top magnetic layer on top of each other with the coil-embedded layer sandwiched in between, to form a laminate; and a step to pressure-bond the laminate. The aforementioned and other purposes, characteristics and benefits of the present invention become clear from the detailed explanations below and attached drawings.

According to the present invention, in a laminated electronic component constituted by multiple laminated insulator layers, each with wires comprising conductors formed on the surface, adjacent wires sandwiching each insulator layers are connected by a connection conductor formed in a manner filling inside and projecting on top of a via hole penetrating through the insulator layer. Additionally, the connection conductor is shaped in such a way that its center is recessed to become lower than the outer periphery of the via hole. As a result, the proportion of the internal conductor at the connection part to that at the non-connection part is lowered, and consequent cracking can be prevented. In addition, less material is required because the amount of internal conductor at the connection part is reduced. Furthermore, shorting defects can be prevented by thickly forming the insulator layer between the connection conductor and adjacent wires.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

Figure 1:
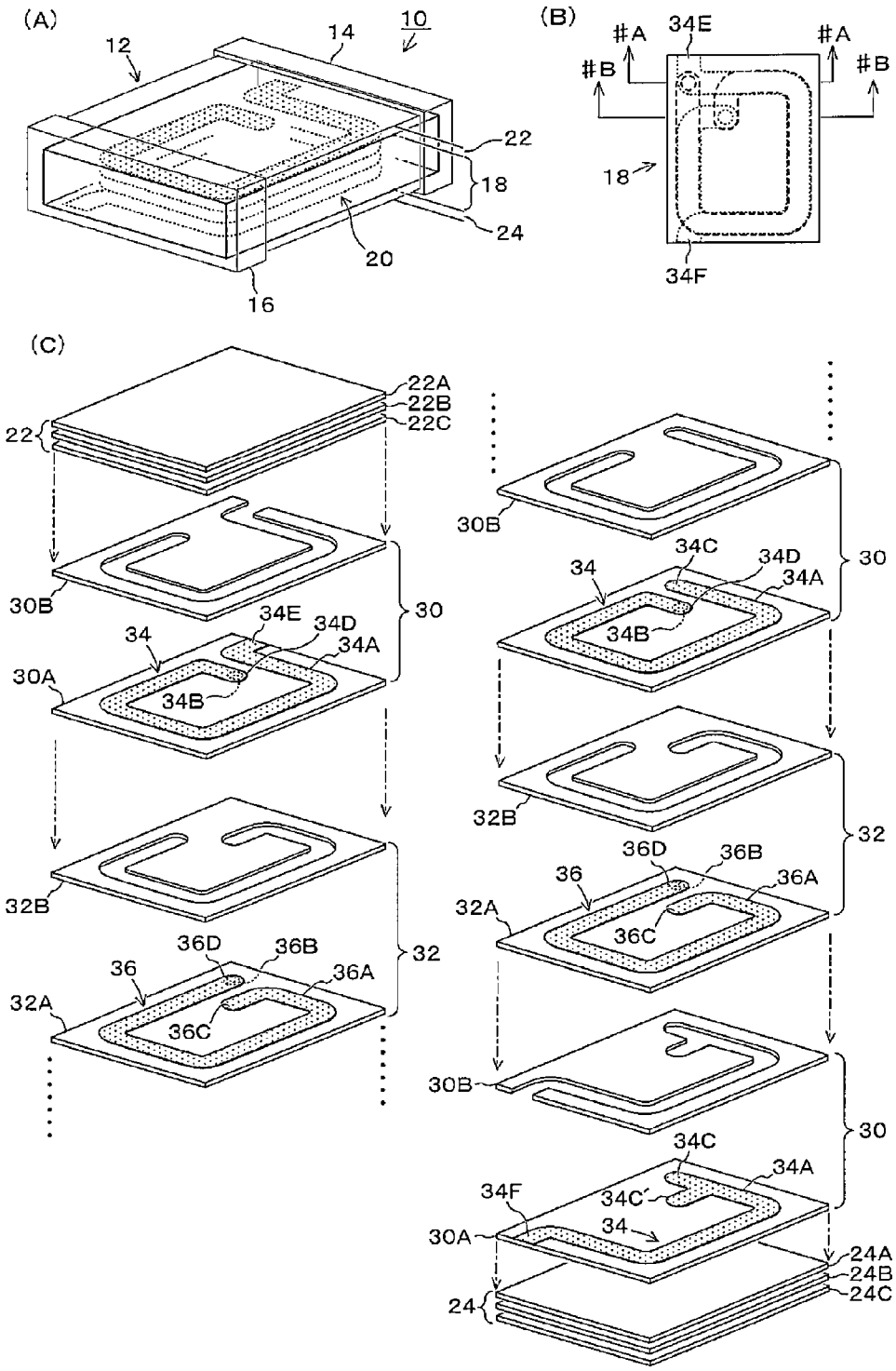
FIG. 1 is a drawing that illustrates Example 1 conforming to the present invention, where (A) is an external perspective view of a laminated chip inductor, (B) is a plan view of its laminate, and (C) is a perspective view showing the condition of the laminate before lamination.

10: Laminated chip inductor
12: Laminate
14, 16: External electrode
18: Coil-embedded layer
20: Coil conductor
22: Top magnetic layer
22A to 22C: Magnetic sheet
24: Bottom magnetic layer

24A to 24C: Magnetic sheet
30: First insulator layer
30A: First insulator sheet
30B: Insulator layer
32: Second insulator layer
32A: Second insulator sheet
32B: Insulator layer
34: First coil conductor
34A, 36A: Line
34B, 36B: Via hole
34C, 34C', 36C: Land
34D, 36D: Connection conductor
34E, 34F: Leader
36: Second coil conductor
38: Recess
40: PET film
50: Screen
52: Mesh
54: Pattern
100: Laminated electronic component
102: Laminate
104A to 104K: Insulator layer
106: Coil pattern
106A, 106B: Land
108: Via

DETAILED DESCRIPTION OF EMBODIMENTS

The best mode for carrying out the present invention is explained in detail below based on an example.

Example 1

Figure 2:
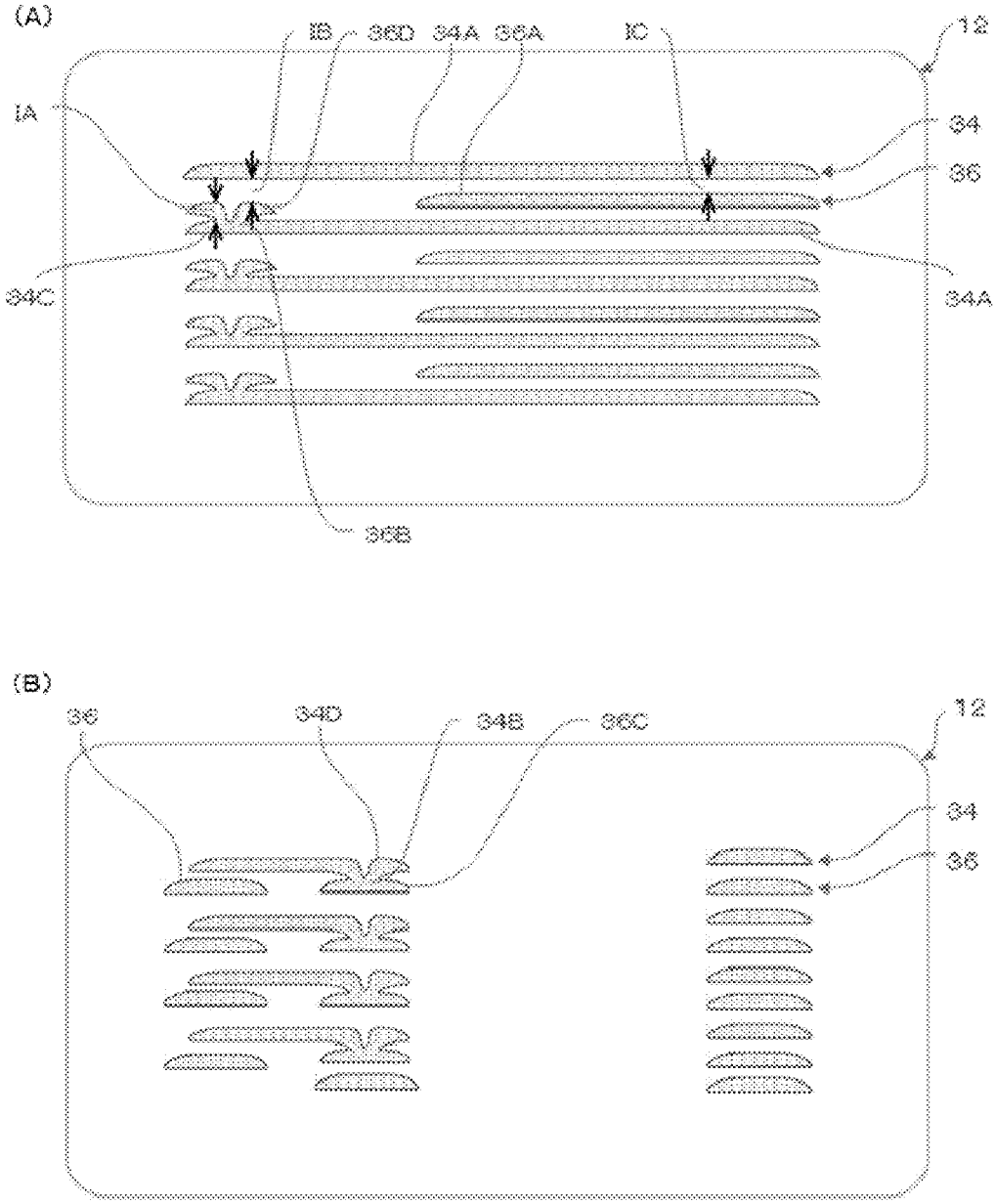
FIG. 2(A) is a section view of FIG. 1(B) above, cut along line #A-#A and viewed in the direction of the arrow, while (B) is a section view of FIG. 1(B) above, cut along line #B-#B and viewed in the direction of the arrow.

First, the structure of the laminated chip inductor in this example is explained by referring to FIGS. 1 and 2. The present invention can be applied to all laminated electronic components having a laminated wire structure, but this example is explained by citing, as an example, a laminated chip inductor having a spiral coil conductor formed in an insulator. FIG. 1(A) is an external perspective view of the laminated chip inductor in this example, FIG. 1(B) is a plan view of its laminate, and FIG. 1(C) is a perspective view showing the condition of the laminate before lamination. FIG. 2(A) is a section view of FIG. 1(B) above, cut along line #A-#A and viewed in the direction of the arrow, while FIG. 2(B) is a section view of FIG. 1(B) above, cut along line #B-#B and viewed in the direction of the arrow. As shown in FIG. 1(A), the laminated chip inductor 10 in this example has a structure whereby external electrodes 14, 16 are formed on both end faces of a laminate 12 that sandwiches, between a top magnetic layer 22 and bottom magnetic layer 24, a coil-embedded layer 18 in which a spiral coil conductor 20 is embedded.

The coil-embedded layer 18 comprises multiple laminated insulator layers. To be specific, it is formed by laminating multiple first insulator sheets 30A, each having a first coil conductor 34 formed on the surface, alternately with multiple second insulator sheets 32A, each having a second coil conductor 36 formed on the surface, as shown in FIG. 1(C). The first coil conductor 34 and second coil conductor 36 constitute a part of the coil conductor 20, are formed by a conductor, and are connected by connection conductors 34D, 36D mentioned later, respectively. In this example, an insulator layer 30B is provided on the first insulator sheet 30A to make the insulator layer above the connection conductor 34D thicker. The first insulator sheet 30A and insulator layer 30B constitute a first insulator layer 30. Similarly, an insulator layer 32B is provided on the second insulator sheet 32A to make the insulator layer above the connection conductor 36D thicker, and the second insulator sheet 32A and insulator layer 32B constitute a second insulator layer 32.

The first coil conductor 34 is formed on the first insulator sheet 30A in a manner winding roughly one full turn, where a land 36C is formed on one end of a line (or winding part) 34A, while the connection conductor 34D is formed on the other end. The connection conductor 34D is formed in a manner covering the top of a via hole 34B provided in the first insulator sheet 30A, and is larger than the outer periphery shape of the via hole 34B, before the laminate is pressure-bonded. When the laminate 12 is pressure-bonded, the air sealed in the via hole 34B is pushed out and consequently a part filling the via hole 34B and another part projecting on top of it are formed, with the center becoming recessed compared to the outer periphery of the via hole 34B (refer to FIG. 2(B)).

On this first insulator sheet 30A on which the first coil conductor 34 is formed, the insulator layer 30B is formed by means of reverse printing in a manner covering the parts other than the first coil conductor 34 and also covering the connection conductor 34D. The first coil conductor 34 formed on the first insulator sheet 30A positioned as the top layer has a leader 34E formed on it for connecting to the one external electrode 14 mentioned above. Also, the first coil conductor 34 formed on the first insulator sheet 30A positioned as the bottom layer is formed by less than one winding, with a leader 34F formed on it for connecting to the other external electrode 16. The first coil conductor 34 at the bottom layer is connected by the land 34C if the coil conductor placed directly on top is the second coil conductor 36. In this example, however, another land 34C' is provided in the direction orthogonal to the land 34C so that connection can be made even when the coil conductor placed directly on top is the first coil conductor 34 (refer to FIG. 1(C)). Furthermore, although the insulator layer 30B is also provided on the first insulator sheet 30A at the bottom layer, the first coil conductor 34 at the bottom layer has no via hole or connection conductor and consequently the insulator layer 30B is shaped in such a way as to cover the parts other than the first coil conductor 34.

Next, the second coil conductor 36 is formed on the second insulator sheet 32A in a manner winding roughly one full turn, where the land 36C is formed on one end of a line (or winding part) 36A, while the connection conductor 36D is formed on the other end. The connection conductor 36D is formed in a manner covering the top of a via hole 36B provided in the second insulator sheet 32A, and is larger than the outer periphery shape of the via hole 36B, before the laminate is pressure-bonded (refer to FIG. 3(A)). When the laminate 12 is pressure-bonded, the air sealed in the via hole 36B is pushed out and consequently a part filling the via hole 36B and another part projecting on top of it are formed, with the center becoming recessed compared to the outer periphery of the via hole 36B, as shown in FIGS. 2(A) and 3(D). On this second insulator sheet 32A on which the second coil conductor 36 is formed, the insulator layer 32B is formed by means of reverse printing in a manner covering the parts other than the second coil conductor 36 and also covering the connection conductor 36D.

The aforementioned first insulator layer 30 on which the first coil conductor 34 is formed, and second insulator layer 32 on which the second coil conductor 36 is formed, are laminated to the specified number of layers. Then, to the land 34C of the first coil conductor 34, the connection conductor 36D formed at the end of the second coil conductor 36 is connected via the via hole 36B formed in the second insulator sheet 32A constituting the top layer. Similarly, to the land 36C of the second coil conductor 36, the connection conductor 34D formed at the end of the first coil conductor 34 is connected via the via hole 34B formed in the first insulator sheet 30A constituting the top layer. By thus connecting the first coil conductor 34 and second coil conductor 36 via the connection conductors 34D, 36D, the coil-embedded layer 18 in which the spiral coil conductor 20 is embedded in the laminate comprising multiple insulator layers is formed.

The top magnetic layer 22 is a laminate of multiple (three in the illustrated example) magnetic sheets 22A to 22C, and placed above the coil-embedded layer 18. The bottom magnetic layer 24 is a laminate of multiple (three in the illustrated example) magnetic sheets 24A to 24C, and placed below the coil-embedded layer 18.

Figure 3:
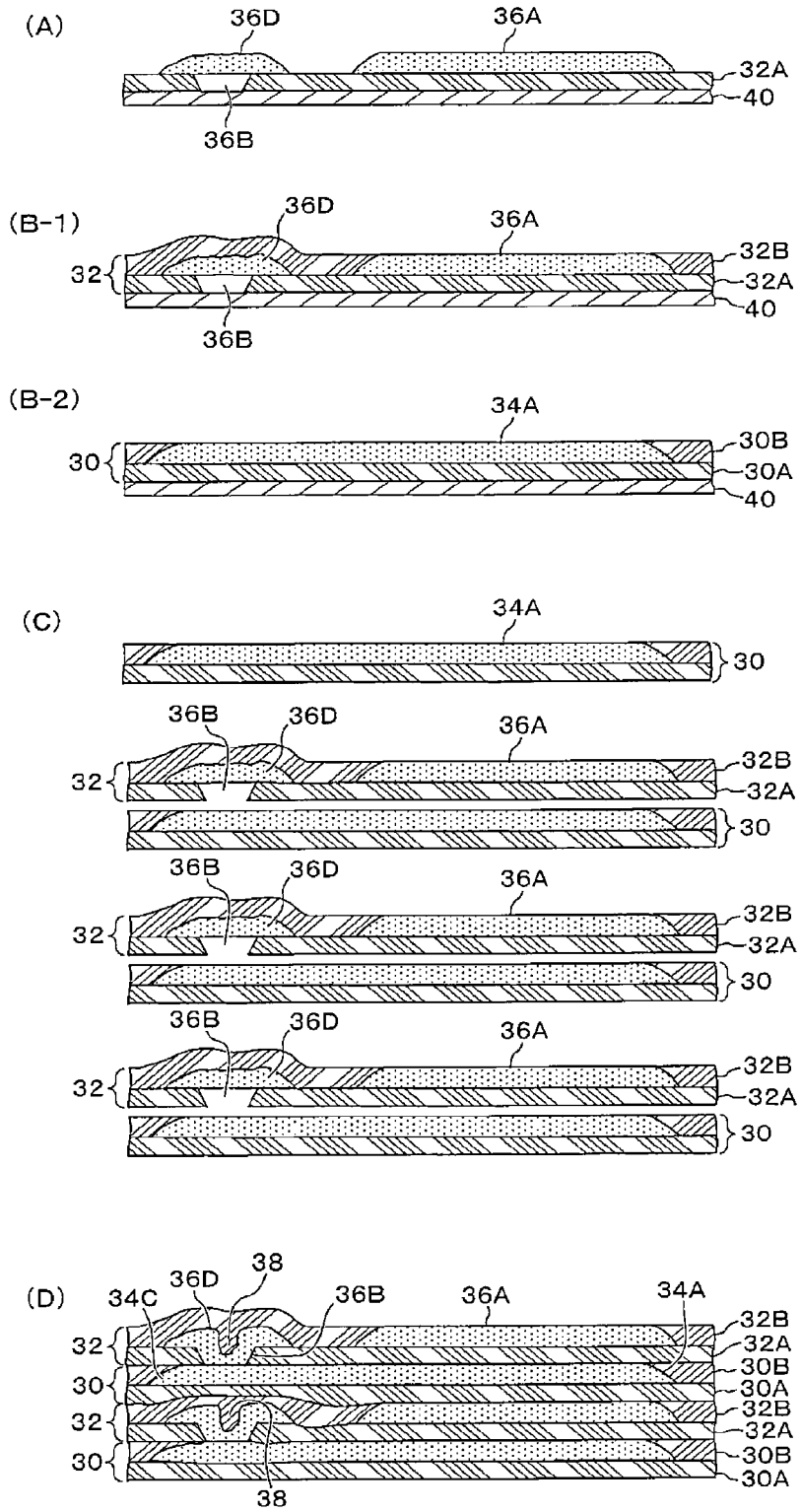
FIG. 3 is a drawing that illustrates an example of the manufacturing process in Example 1 above, using a section of FIG. 1(B) above, cut along line #A-#A and viewed in the direction of the arrow.
Figure 4:
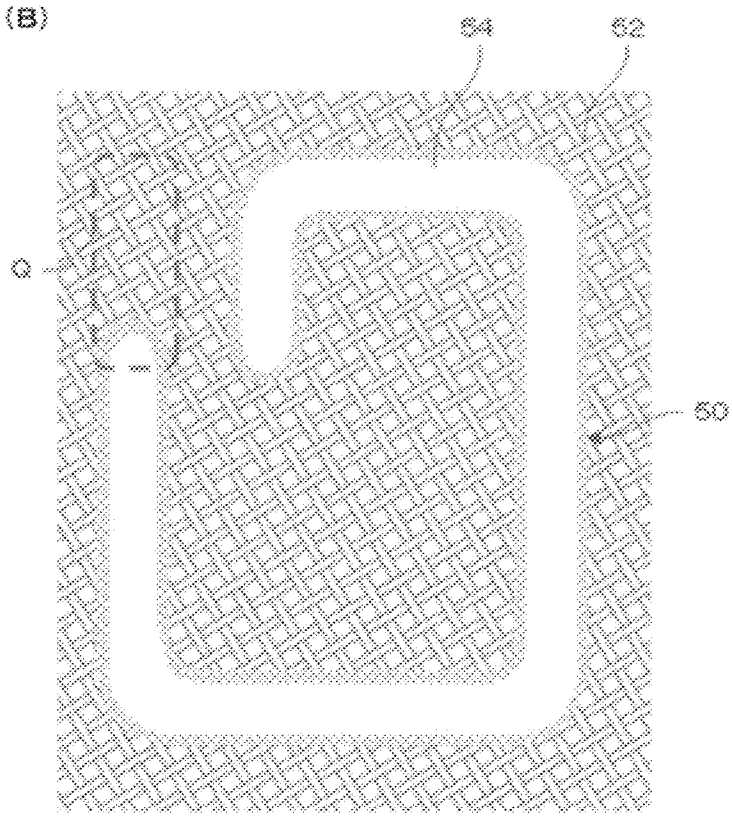
FIG. 4(A) is a plan view of the second insulator sheet after printing of the second coil conductor in Example 1 above, while (B) is a plan view showing the screen used for reverse printing.
Figure 4:
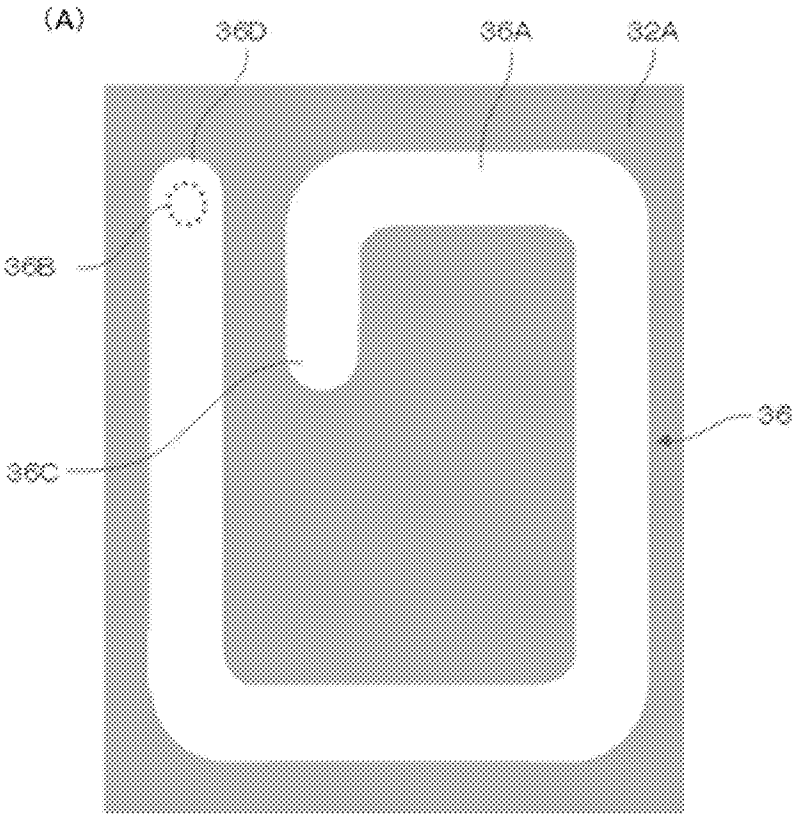
Figure 5:
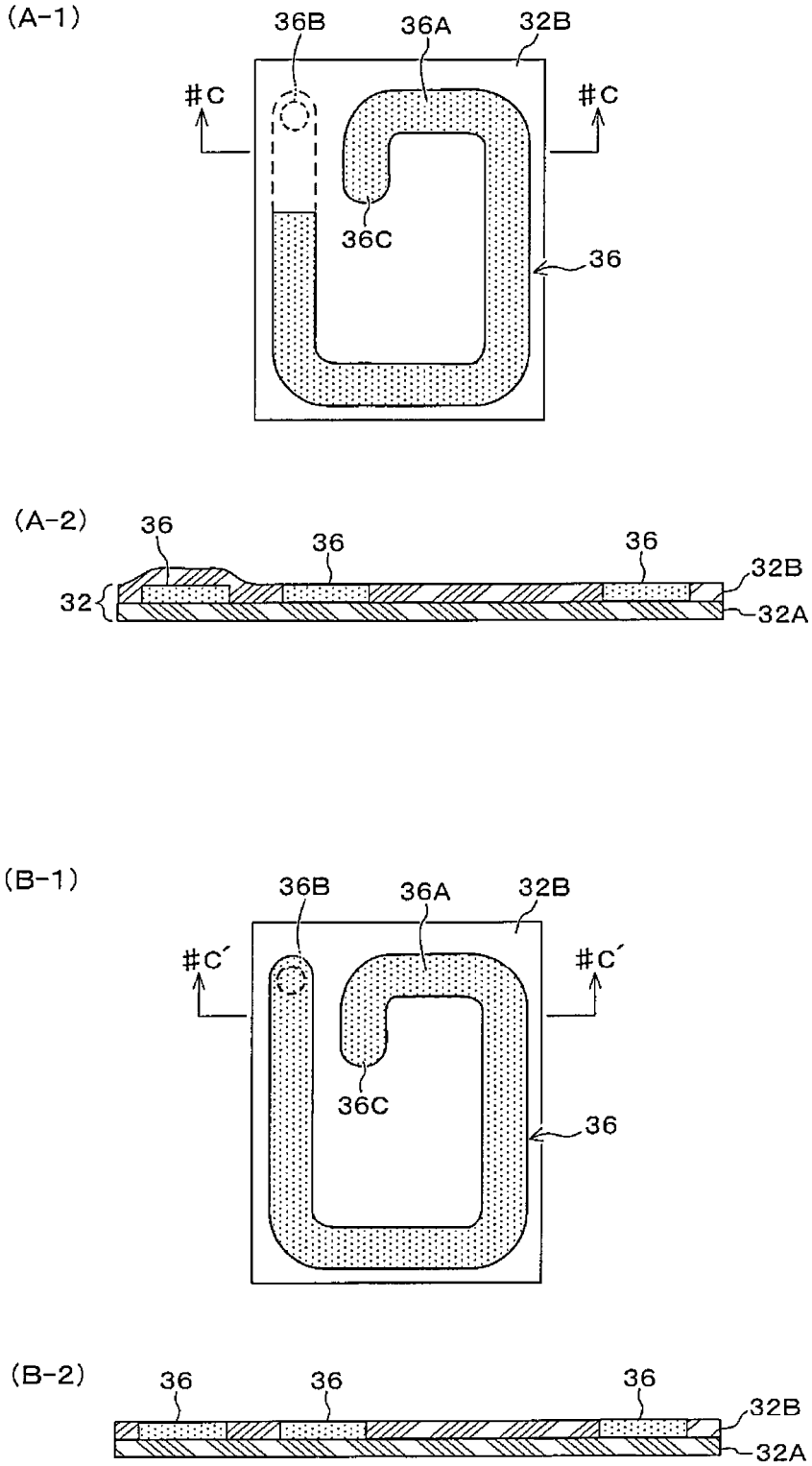
FIG. 5(A-1) is a plan view of the second insulator layer after reverse printing in Example 1 above; (A-2) is a section view of (A-1) above, cut along line #C-#C and viewed in the direction of the arrow; (B-1) is a plan view of the second insulator layer after reverse printing in the comparative example; and (B-2) is a section view of (B-1) above, cut along line #C'-#C' and viewed in the direction of the arrow.
Figure 6:
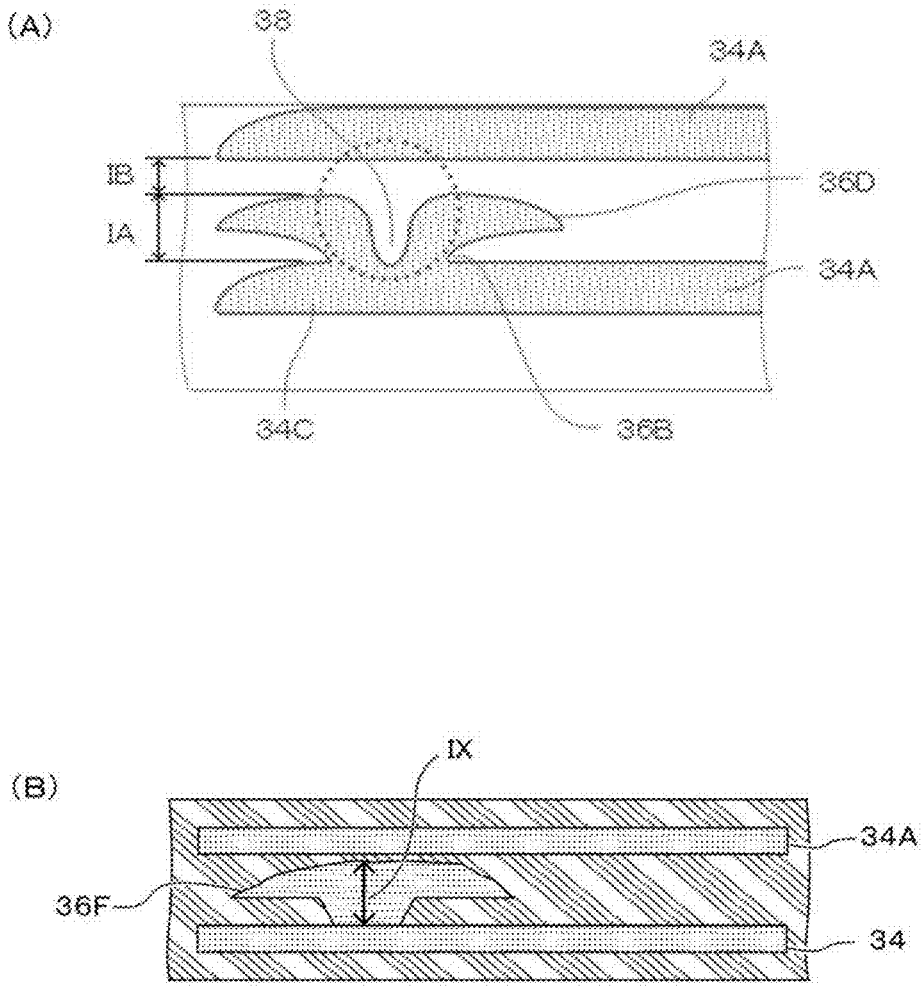
FIG. 6(A) is an enlarged section view of a connection conductor in the example conforming to the present invention, while (B) is an enlarged section view of a connection conductor in the comparative example.
Figure 7:
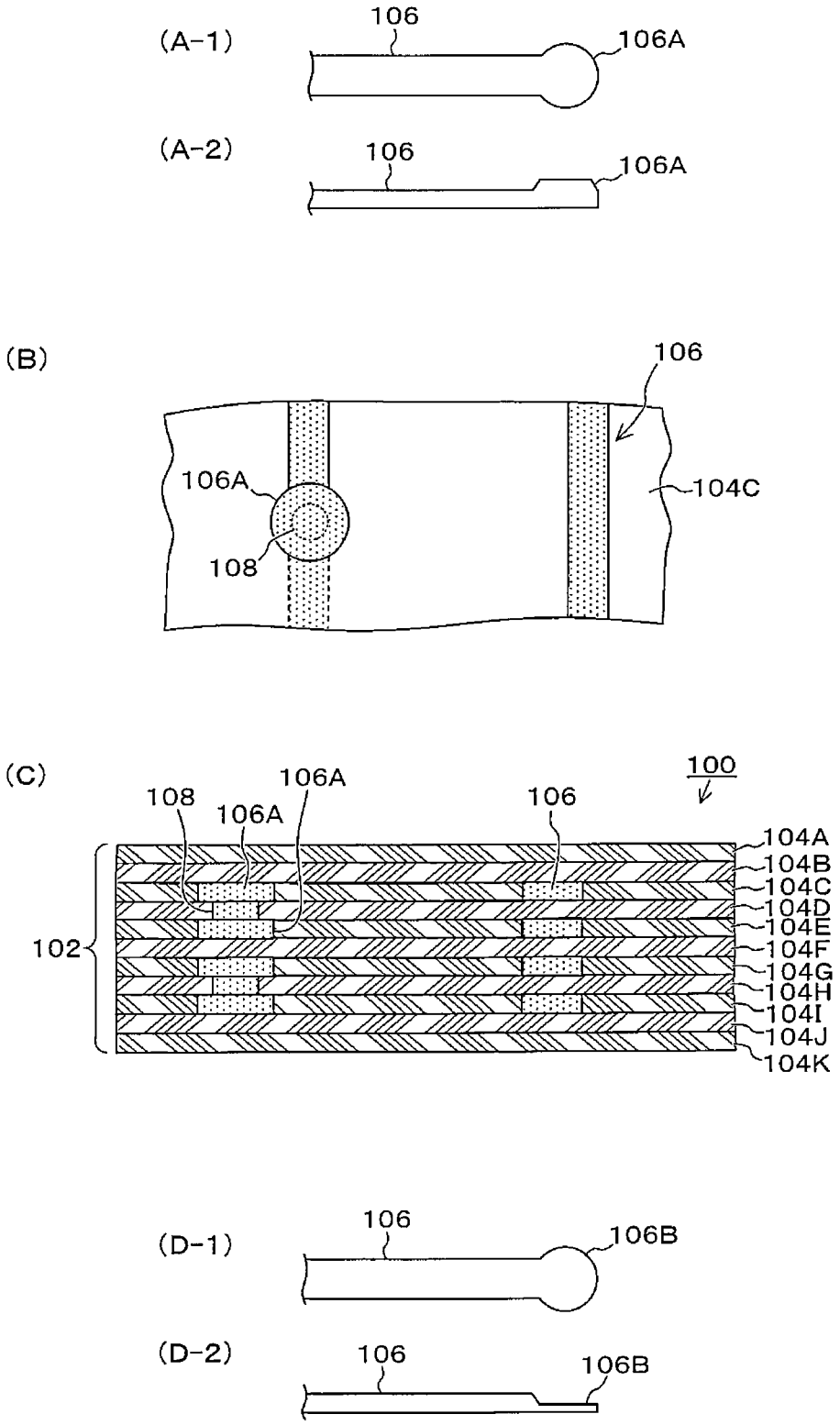
FIG. 7 is a drawing illustrating an example of prior art.

Next, the manufacturing method proposed by the present invention is explained by also referring to FIGS. 3 to 6. FIG. 3 is a drawing that illustrates an example of the manufacturing process in this example using a section of FIG. 1(B) above, cut along line #A-#A and viewed in the direction of the arrow. FIG. 4(A) is a plan view of the second insulator sheet after printing of the second coil conductor in this example, while FIG. 4(B) is a plan view showing the screen used for reverse printing. FIG. 5(A-1) is a plan view of the second insulator layer after reverse printing in Example 1 above, while FIG. 5(A-2) is a section view of (A-1) above, cut along line #C-#C and viewed in the direction of the arrow. FIG. 5(B-1) is a plan view of the second insulator layer after reverse printing in the comparative example, while FIG. 5(B-2) is a section view of (B-1) above, cut along line #C'-#C' and viewed in the direction of the arrow. FIG. 6(A) is an enlarged section view of a connection conductor in this example, while FIG. 6(B) is an enlarged section view of a connection conductor in the comparative example. It should be noted that, because only the connection conductor 36D of the second coil conductor 36 is shown in FIG. 3 due to the cutting position, forming of the connection conductor 36D is mainly explained here; however, the connection conductor 34D of the first coil conductor 34 is basically formed in the same manner. In this example, an example of manufacturing using the sheet method is explained.

First, a green sheet from which to make the materials for the first insulator sheet 30A and second insulator sheet 32A is formed. For the green sheet, a slurry prepared by mixing ferrite powder and binder is coated onto a PET film to the thickness of approx. 30 μm, and then dried to obtain a rolled sheet. The obtained rolled green sheet is cut to the specified dimension using a cutting blade, etc., to obtain a green sheet (of approx. 150 mm in width and 180 mm in length, for example). As shown in FIG. 3(A), the second insulator sheet 32A formed on a PET film 40 uses this green sheet.

Next, the via hole 36B is formed at the specified position of the second insulator sheet 32A using a YAG laser, etc., as shown in FIG. 3(A). As shown in FIG. 3(A), the via hole 36B has a widening shape where the top diameter is larger. By shaping the via hole 36B this way, the connection conductor 36D flows in easily in the pressure-bonding step explained later. Also, the air that escapes as the connection conductor 36D flows in travels to the center more easily, which facilitates the formation of a recess 38 at the center. Preferably the top opening diameter of the via hole 36B is the same as or smaller than the width of the line 36A printed in a subsequent step. If the line 36A is formed at a width of 300 μm, for example, the top opening diameter of the via hole 36B is set to approx. 200 μm. Additionally, preferably the bottom opening diameter of the via hole 36B is set to a degree that does not affect the RDC of the laminated chip inductor 10 and is greater than the diameter of the cross-section area of the internal conductor (cross-section area of the connection conductor 36D shown in FIG. 3(A)). If the internal conductor is 300 μm wide and 40 μm thick, for example, the bottom opening diameter of the via hole is set to approx. 150 μm. Here, since the connection conductor 36D is not a rectangular solid, its cross-section area in the condition shown in FIG. 3(A) is smaller than 300 μm×400 μm=12000 $\mu m^2$. Empirically, the cross-section area of the connection conductor 36D is 8000 $\mu m^2$, being approx. two-thirds of its cross-section area when it is a rectangular solid. Assuming that the opening diameter of the via hole 36B is 150 μm, its area is approx. 17700 $\mu m^2$, meaning that the bottom area of the via hole is greater than the cross-section area of the internal conductor and therefore the RDC of the product will not be affected.

Next, Ag paste is used to screen-print the second coil conductor 36 in a specified shape, and dried as shown in FIG. 3(A). In this example, the second coil conductor 36 is set to approx. 300 μm in width and approx. 40 μm in thickness, with the connection conductor 36D at the end formed in a manner blocking off the top of the via hole 36B and thereby preventing the inside air from escaping. A plan view of the second insulator sheet 32A after printing of the second coil conductor 36 is shown in FIG. 4(A). Next, the insulator layer 32B is formed on the second insulator sheet 32A on which the second coil conductor 36 is printed, in a manner allowing the insulator layer on top of the via hole 36B (indicated by the thickness IB in FIG. 2(A)) to become thicker than the insulator layer on top of the line 36A (indicated by the thickness IC in FIG. 2(A)) (FIG. 3(B-1)). The insulator layer 32B is formed by, for example, printing a sheet material paste. For the sheet material paste, organic binder is mixed into ferrite powder and dispersed using a three-roll mill, etc. The same material from which the green sheet was formed can also be used. A mesh screen is used for printing.

FIG. 4(B) shows an example of a screen 50 used for forming the insulator layer 32B. The screen 50 has a specified pattern 54 formed over a mesh 52 so that the parts other than the second coil conductor 36, and the connection conductor 36D, can be covered with the paste. It should be noted that, with this screen 50, the mesh area covers a wide area so that the paste covers not only the area directly above the connection conductor 36D, but also up to near the land 36C, as indicated by the area Q enclosed by a dotted line in FIG. 4(B). In this example, the second coil conductor 36 is formed by winding approx. one turn, and the land 36C, being the connection part with the first coil conductor 34 on the top layer, is close in position to the via hole 36B being the connection part with the first coil conductor 34 on the bottom layer. As mentioned, however, the insulator layer can be made thicker to unfailingly prevent shorting between the connection parts, by forming the mesh area of the screen 50 to cover up to near the land 36C.

If the thickness of the second coil conductor 36 is 40 μm, the thickness of an emulsifier for the screen 50 is changed to set the thickness of the material paste after printing to between 1.2 and 2.0 times the thickness of the emulsifier. To increase this thickness to 2.0 times, for example, the screen 50 specification is designed based on a thickness difference of 60 μm, emulsifier thickness of 30 μm, and total plate thickness of approx. 90 μm. A plan view after formation of the insulator layer 32B by printing and drying the material paste, is shown in FIG. 5(A-1). FIG. 5(A-2) shows a section of FIG. 5(A-1) above, cut along line #C-#C and viewed in the direction of the arrow. As shown in FIG. 5(A-2), the top of the line adjoining the land 36C is completely covered by the insulator layer 32B. On the other hand, if a patterned screen is used for the part corresponding to the area Q, the insulator layer 32B will not be formed on top of the line adjoining the land 36C, as shown in FIGS. 5(B-1) and 5(B-2).

In the same manner as the formation method of second insulator layer 32 explained above, the first insulator sheet 30A, first coil conductor 34, and reverse-printed insulator layer 30B, are formed on the PET film 40 to obtain the first insulator layer 30, as shown in FIG. 3(B-2). Next, the PET film 40 is removed from the first insulator layer 30 and second insulator layer 32 and the layers are alternately stacked on top of each other in a manner aligning the via hole connection positions, as shown in FIG. 3(C), to obtain the coil-embedded layer 18. The top magnetic layer 22 and bottom magnetic layer 24 prepared in a separate step are overlaid at the top and bottom of the coil-embedded layer 18, after which the layers are pressure-bonded at the specified pressure and temperature to be integrally bonded, as shown in FIG. 3(D). The layers are laminated one by one at a temperature equal to or below the softening point of the sheet (both the insulator layer and magnetic layer). For example, the layers are laminated one by one on a base being a 65° C. metal plate, under the conditions of 60 tons for 5 seconds or so. To integrally bond the laminated bar, pressure-bond the bar by applying pressure under the conditions of 90° C., 25 tons, and approximately 180 seconds, for example. Here, preferably the temperature is set at or above the softening point of the internal conductor (first coil conductor 34, second coil conductor 36).

Pressurization compresses the air that has been trapped inside the via hole 36B by the connection conductor 36D. At the same time, the viscosity of the connection conductor 36D can be changed by heating to let the connection conductor 36D flow to the side face and bottom face of the via hole 36B in order to replace the air inside the via hole 36B. This thermal pressure-bonding step forms the connection conductor 36D having the recess 38 at the center of the via hole 36B, while also connecting the first coil conductor 34 and second coil conductor 36 on the bottom layer, as shown in FIGS. 2(A) and 6(A). The same goes with the connection of the connection conductor 34D for the first coil conductor 34 with the second coil conductor 36 on the bottom layer (refer to FIG. 2(B)).

Then, the pressure-bonded product obtained in the aforementioned pressure-bonding step is adsorbed onto a metal plate that has been heated to 80° C., for example, and then pressed and cut at the specified position to make it into a chip shape. The obtained chip is barreled to remove edges. Thereafter, the chip is made binder-free and then sintered to obtain a sintered product. To prevent cracking due to sudden binder removal and sintering, preferably binder removal and sintering are implemented over a time of approx. 13 hours, for example. Then, the chip obtained from the binder removal/sintering step is dip-coated with Ag paste, followed by drying and baking, to obtain the external electrodes 14, 16. If necessary, apply Ni+Sn plating onto the external electrodes 14, 16 to obtain the laminated chip inductor 10.

Next, reliability test of the laminated chip inductor 10 conforming to this example is explained. First, the relationship between the thickness of the internal conductor of the connection conductor on one hand, and the percent defective (%) due to cracking and shorting on the other, is explained. Table 1 below shows the cracking and shorting ratios when the ratio of the actual thickness IA (refer to FIGS. 2(A) and 6(A)) of the internal conductor of the connection part, to the thickness of the internal conductor at the part other than the connection conductor (thickness of the line 36A), is changed. Here, the thickness of the internal conductor at the part other than the connection conductor was fixed at 40 μm. As shown in Table 1, cracking or shorting occurred when the thickness ratio of the internal conductor becomes 1.5, but no such defect was observed at lower ratios. Although the actual thickness IA was less than 50 μm according to the manufacturing method in this example, in some cases the thickness IX of the internal conductor at the connection part became 60 μm when the conventional shape shown in FIG. 6(B) was used, resulting in shorting and cracking As mentioned above, the actual thickness IA was less than 50 μm according to the manufacturing method in this example. For the purpose of verification, however, the viscosity of the internal conductor paste was lowered and fluidity was increased to obtain the samples of 55 μm and 60 μm in actual thickness IA as shown in Table 1 below. Then, the printing conditions were changed to prepare samples whose via hole was fully filled with the internal conductor, in the same manner as with the conventional shape shown in FIG. 6(B).

TABLE 1

| Thickness of internal conductor | | Percent defective (%) | |
|---|---|---|---|
| Actual thickness IA of connection conductor (μm) | Ratio of thickness of internal conductor to part other than connection conductor | Cracking | Shorting |
| 40 | 1.0 | 0 | 0 |
| 45 | 1.1 | 0 | 0 |
| 50 | 1.3 | 0 | 0 |
| 55 | 1.4 | 0 | 0 |
| 60 | 1.5 | 2 | 1 |

Next, the relationship between the thickness of the insulator layer on one hand, and the percent defective (%) due to cracking and shorting on the other, is explained. Table 2 below shows the cracking and shorting ratios when the ratio of the thickness IB (refer to FIG. 2(A)) of the insulator layer on top of the connection part (on top of the via hole), to the thickness IC (refer to FIG. 2(A)) of the insulator layer between the coil conductor at the part other than the connection conductor and the coil conductor on the adjacent layer, is changed. Here, the insulator layer corresponding to the thickness IC corresponds to the thickness of the first insulator sheet 30A, while the insulator layer corresponding to the thickness IB corresponds to the first insulator sheet 30A plus the insulator layer 32A. Here, the thickness IC was fixed at 20 μm.

As shown in Table 2, shorting occurred when the thickness IB of the insulator layer was smaller than the thickness IC, but such defect was not observed when the thickness IB was equal to or greater than the thickness IC. This indicates that, from the viewpoint of preventing shorting, preferably the thickness IC of the insulator layer on top of the connection part is equal to or greater than the thickness of the insulator layer on top of the internal conductor at the part other than the connection part.

TABLE 2

| Thickness of insulator layer | | Percent defective (%) | |
|---|---|---|---|
| Actual thickness IB on top of via hole (μm) | Ratio of thickness IC of insulator between conductors at part other than via hole | Cracking | Shorting |
| 10 | 0.5 | 0 | 10 |
| 20 | 1.0 | 0 | 0 |
| 30 | 1.5 | 0 | 0 |
| 40 | 2.0 | 0 | 0 |
| 50 | 2.5 | 0 | 0 |

As shown above, under Example 1 the spiral coil conductor 20 is formed by laminating the first insulator layers 30, each having the first coil conductor 34 formed on it, alternately with the second insulator layers 32, each having the second coil conductor 36 formed on it, and then using the connection conductors 34D, 36D to inter-connect the adjacent coil conductors sandwiching each insulator layer. The following effects are obtained by shaping the connection conductors 34D, 36D in such a way that their centers are recessed to become lower than the outer peripheries of the via holes 34B, 36B.

(1) The proportion of the internal conductor at the connection part to that at the part other than the connection part becomes lower, and consequently cracking can be prevented.

(2) Since the amount of internal conductor at the connection part decreases, less material is required and the cost also drops.

(3) By forming the insulator layer thickly between the coil conductors adjacent to the connection conductor, shorting defects can be prevented. As a result, shorting can be prevented with a power inductor, even when the thickness of internal conductor is increased to lower the resistance.

(4) By forming the connection conductor in a manner blocking off the top of the via hole provided on the insulator sheet and then heating/pressure-bonding the laminate, air inside the via hole can be pushed out to facilitate the formation of the aforementioned shape.

(5) Because other insulator layer is formed on the insulator sheet on which the coil conductor has been formed, in a manner covering the parts other than the coil conductor and also covering the connection conductor, the insulator layer can be formed thickly on the connection conductor.

(6) Since other insulator layer formed on the insulator sheet covers the connection conductor, shorting can unfailingly be prevented even when roughly a single-winding (single-turn) pattern is formed on one insulator layer and the connection part is close, as shown in this example.

It should be noted that the present invention is not limited to the aforementioned example in any way, and various changes can be made to the extent that they do not deviate from the main purpose of the present invention. For example, the present invention also includes the following:

(1) The shapes and dimensions indicated in the example are only examples and can be changed as deemed appropriate to the extent that similar effects can be achieved.

(2) The materials indicated in the example are only examples, as well, and various known materials can be utilized as long as similar effects can be achieved.

(3) The pattern shapes of the first coil conductor 34 and second coil conductor 36 indicated in the example are only examples, as well, and design changes can be made as deemed appropriate as long as similar effects can be achieved. For example, the coil conductor roughly has a single-turn shape in the example, but this is only an example and it can be changed as deemed appropriate, such as one-half a turn or three-quarters of a turn, as long as the coil is wound at least one-half a turn.

(4) The number of first insulator layers 30 and second insulator layers 32 to be laminated in the example is only an example, as well, and can be increased or decreased as deemed appropriate, if needed.

(5) A laminated chip inductor was used to explain the example, but the present invention can be applied to all LTCC (low temperature co-fired ceramics) and other laminated electronic components having a laminated wiring structure whereby lines (wires) formed in insulators are inter-connected through via holes.

(6) In the example, the center of the connection conductor is recessed and has a bottom surface. Under the present invention, however, the shape of the connection conductor changes depending on the relationships of the size and shape of the via hole 34B or 36B, amount of the connection conductor 34D or 36D, and applied pressure, among others. For example, similar actions and effects are achieved with other shapes, including when the connection conductor becomes lower toward the center, just like a spatial shape formed by vortex, and there is virtually no bottom surface at the center. Accordingly, the term "recessed" used in this Specification has a wider scope than the meaning normally conveyed by this term.

According to the present invention, multiple layers, each with wires comprising conductors formed on the surface, are laminated and adjacent wires sandwiching each insulator layer are inter-connected through connection conductors formed in a manner filling inside and projecting on top of via holes that penetrate the insulator layer. Then, each connection conductor is shaped in such a way that its center is recessed to become lower than the outer periphery of the via hole, to lower the proportion of the internal conductor at the connection part and thereby prevent cracking Also by forming the insulator layer thickly between the connection conductor and adjacent wires, shorting defects can be prevented. As a result, the present invention can be applied to laminated electronic components having a structure whereby wires are inter-connected through via holes in insulator layers. The present invention is particularly suited for inductors used in power-supply circuits.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, an article "a" may refer to a species or a genus including multiple species, and "the invention" or "the present invention" may refer to at least one of the embodiments or aspects explicitly, necessarily, or inherently disclosed herein. In this disclosure, any defined meanings do not necessarily exclude ordinary and customary meanings in some embodiments.

The present application claims priority to Japanese Patent Application No., 2011-275127, filed Dec. 15, 2011 and No. 2012-259221, filed Nov. 27, 2012, each disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

I claim:

1. A laminated electronic component having a structure whereby multiple insulator layers, each with wires comprising conductors formed on a surface, are laminated and said wires on the respective insulator layers are connected, wherein adjacent wires sandwiching each insulator layer are inter-connected by connection conductors formed by conductors in a manner filling and projecting on top of via holes that penetrate the insulator layer;

the connection conductors are recessed at a center to become lower than outer peripheries of the via holes;

the wires are coil conductors constituting a part of a spiral coil conductor and their inter-connection by the connection conductors form the spiral coil conductor in a laminate of multiple insulator layers; and in an insulation layer between the wire having the connection conductor formed on another insulation layer and an adjacent wire above the aforesaid wire with an insulator layer provided in between, a thickness of the insulator layer between the connection conductor and the adjacent wire is greater than a thickness of the insulator layer between a wiring part of the aforesaid wire other than the connection conductor and the adjacent wire.

2. The laminated electronic component according to claim 1, wherein the insulator layer between the connection conductor and the adjacent wire has a double layer structure.

3. A laminated electronic component having:

a coil-embedded layer where a spiral coil conductor is embedded over multiple insulator layers;

a top magnetic layer laminated on a top side of the coil-embedded layer and formed by multiple magnetic layers; and a bottom magnetic layer laminated on a bottom side of the coil-embedded layer and formed by multiple magnetic layers;

wherein the coil conductor integrally comprises:

multiple first coil conductors that are each formed over at least one-half a turn on one insulator layer and provided on each of multiple insulator layers to constitute a part of the coil conductor;

multiple second coil conductors alternating with the first coil conductors, which are each formed over at least one-half a turn on one insulator layer and provided on each of multiple insulator layers to constitute a part of the coil conductor;

a first connection conductor formed on one end of the first coil conductor in a manner filling inside and projecting on top of a via hole provided in an insulator layer having the first coil conductor formed thereon, wherein the first connection conductor is shaped in such a way that a center of the first connection conductor is recessed to become lower than an outer periphery of the via hole, and connects to a part of the second coil conductor below the first connection conductor through the part filling the via hole;

a second connection conductor formed on one end of the second coil conductor in a manner filling inside and projecting on top of a via hole provided in an insulator layer having the second coil conductor formed thereon, wherein the second connection conductor is shaped in such a way that a center of the second connection conductor is recessed to become lower than an outer periphery of the via hole, and connects to a part of the first coil conductor below the second connection conductor through the part filling the via hole;

in an insulation layer between the first coil conductor and the adjacent second coil conductor above the first coil conductor with an insulator layer provided in between, a thickness of the insulator layer between the first connection conductor and the second coil conductor is greater than a thickness of the insulator layer between a wiring part of the first coil conductor other than the first connection conductor and the second coil conductor; and in an insulation layer between the second coil conductor and the adjacent first coil conductor above the second coil conductor with an insulator layer provided in between, a thickness of the insulator layer between the second connection conductor and the first coil conductor is greater than a thickness of the insulator layer between a wiring part of the second coil conductor other than the second connection conductor and the first coil conductor.

4. The laminated electronic component according to claim 3, wherein the insulator layer between the first connection conductor and the second coil conductor above the first connection conductor has a double layer structure, and the insulator layer between the second connection conductor and the first coil conductor above the second connection conductor has a double layer structure.

* * * * *